United States Patent [19]

Terry

[11] 4,216,464

[45] Aug. 5, 1980

[54] SOUND RESPONSIVE LIGHT DEVICE

[76] Inventor: Edward E. Terry, 2363 North O'Neal Ave., Charleston, S.C. 29404

[21] Appl. No.: 2,616

[22] Filed: Jan. 11, 1979

[51] Int. Cl.[2] ..... G08B 5/22; F21V 21/12

[52] U.S. Cl. ..... 340/321; 362/103; 340/148

[58] Field of Search ..... 340/148, 321; 339/11; 362/103, 811; 84/464 R

[56] References Cited

U.S. PATENT DOCUMENTS

| | | | |
|---|---|---|---|
| 2,378,075 | 6/1945 | Frecska | 340/321 |
| 3,153,745 | 10/1964 | Gurian et al. | 340/321 |
| 3,549,878 | 12/1970 | Bailey | 362/103 |
| 3,579,187 | 5/1971 | Knott | 340/148 |

*Primary Examiner*—Donald J. Yusko

*Attorney, Agent, or Firm*—Larry H. Kline

[57] ABSTRACT

A device which comprises a belt, a power source, sound responsive circuitry and lights secured to the belt with the lights responsive to the sound responsive circuitry.

27 Claims, 6 Drawing Figures

SOUND RESPONSIVE LIGHT DEVICE

This invention relates to belts, and more particularly to a belt which comprises lights which are operative responsive to sound responsive means.

Sound and music are a part of everyday life. The present invention relates to a belt containing lights which are responsive to sounds or music. The lights vary in intensity with respect to the sound in the area of the belt. Lights have been previously placed on belts. Frecska U.S. Pat. No. 2,378,075; Gendron U.S. Pat. No. 3,641,333; and Cukale U.S. Pat. No. 3,840,853 have placed lights on belts. The present invention differs substantially from these Patents. The present invention is responsive to sound and the intensity of the lights varies accordingly.

An object of the present invention is to provide a belt with lights thereon which are operative responsive to sound responsive means.

Another object of the present invention is to provide a belt with lights thereon with the belt being adjustable in size.

Still another object of the present invention is to provide a belt with lights thereon with lights being moveable on the belt as desired.

A further object of the present invention is to provide a belt with lights thereon with the lights being wired in parallel so that an open circuit in any one light will not effect the operation of the other lights.

Another object of the present invention is to provide a belt with lights thereon with electrical conductors placed within the belt.

These and other objects and features of the invention will be apparent from the following description and appended claims.

Briefly, the invention is a device connected around a body comprising a belt, power means, and light means secured to the belt. The light means is operative responsive to the sound responsive means. The belt comprises a plurality of belt sections and a plurality of fasteners connecting the plurality of belt sections together. The belt also comprises a plurality of upper and lower conducting holes. An upper conductor extends through each of the upper conducting holes. A lower conductor extends through each of the lower conducting holes. Each belt section has a fastener hole through which a fastener may be secured. An insert may be connected between any two belt sections. A female and a male electrical connector are secured onto the end of each belt section. The belt sections are electrically connectable to each other. The insert has a female and a male electrical connector on each end. The insert is electrically connectable to the other belt sections. The insert has two fastener holes, one at each end. A fastener is secured through each fastener hole. More than one insert may be utilized. The sound responsive means may comprise a microphone. The lights means may comprise a plurality of lights. Each of the plurality of lights may comprise a base, a bulb holder secured to the base, a bulb secured within the bulb holder, a reflector and a lens cover. The lens cover for each light may be any color and may be interchangeable with any other color lens cover. A plurality of conducting shafts are secured to the base of the lights and are electrically connected to the bulbs. The power means, the sound responsive means, and a switch means are connected in series within a power pack. The power pack is secured on a power pack base. A plurality of power pack bases containing shafts is secured to the power pack base and is electrically connected to the series circuit of the switch means, power means, and sound responsive means. Some of the plurality of conducting shafts and power pack conducting shafts each extend through one of the plurality of upper conducting holes in the belt and make electrical contact with the upper conductor. Some of the plurality of conducting shafts and power pack conducting shafts each extend through one of the plurality of lower conducting holes in the belt and make electrical contact with the lower conductor. The plurality of lights are connected together in parallel. The power pack is electrically connected in parallel with the plurality of lights. The plurality of conducting shafts and the plurality of power pack conducting shafts are secured to the belt by a plurality of non-conducting means, such as a plurality of screws.

The invention will be more fully understood from the following detailed description and appended claims when taken with the drawings in which:

Figure 3:
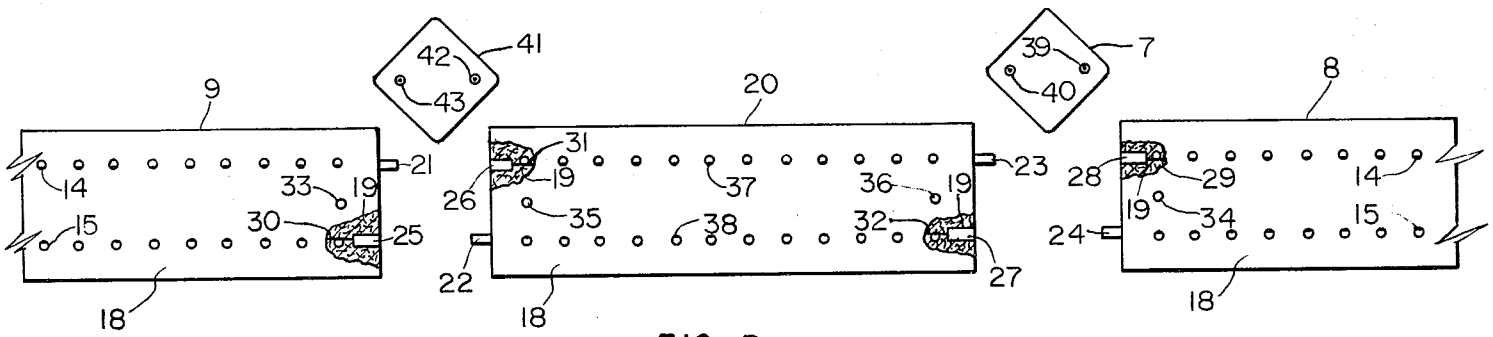

FIG. 3 is an enlarged, exploded, back view of insert belt section 20 placed between belt sections 8 and 9 with cut-away sections showing electrical connections.

Figure 4:
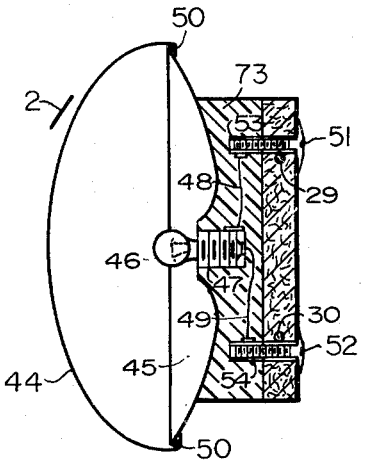

FIG. 4 is an enlarged sectional view of light 2 which is attached to belt 1.

Figure 5:
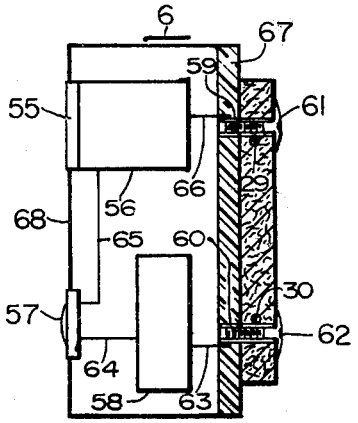

FIG. 5 is an enlarged cut-away view of power pack 6 attached to belt 1.

Figure 6:
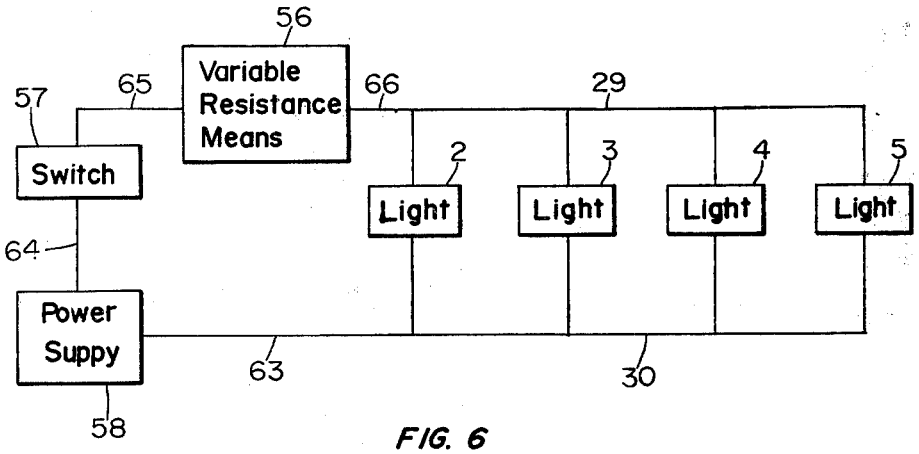

FIG. 6 is a black box schematic diagram of the electrical configuration of the belt and the attachments.

Figure 1:
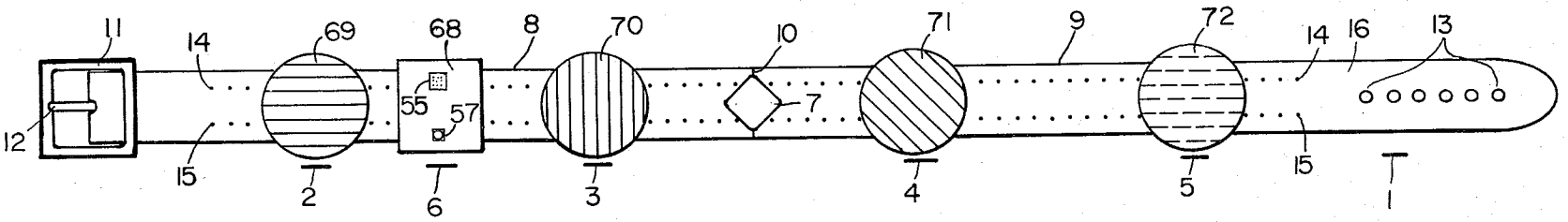
FIG. 1 is a plain front view of the belt 1 with various lights and a power pack secured thereon.

Referring now to the drawings, FIG. 1 is a plain front view of belt 1. Lights 2, 3, 4 and 5 are secured onto belt 1. Power pack 6 is secured onto belt 1. Belt 1 comprises belt first section 8 and belt second section 9. Belt first section 8 and belt second section 9 meet at seam 10 where they are secured by belt fastener 7. Belt 1 may be secured about a person by use of buckle 11 at the end of belt first section 8. The end of belt second section 9 is placed through buckle 11 where fastener extention 12 is placed through one of the plurality of holes 13 in order to secure the belt 1 about the person. The plurality of lights 2, 3, 4 and 5 and the power pack 6 are secured to belt 1 through a plurality of upper conducting holes 14 and a plurality of lower conducting holes 15. Light 2 is shown with lens cover 69, light 3 is shown with lens cover 70, light 4 is shown with lens cover 71 and light 5 is shown with lens cover 72. These lens covers are changeable, easily replaceable and may be of different colors and designs as desired.

Figure 2:
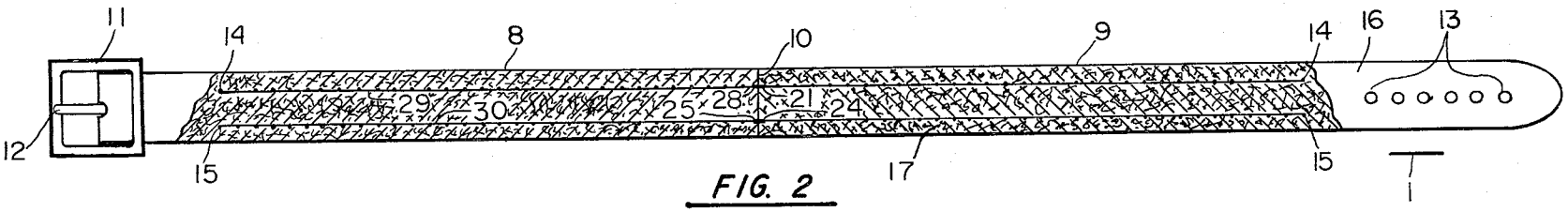
FIG. 2 is a cut-away view of belt 1 showing interior wiring.

FIG. 2 is a cut-away view of belt 1 showing interior wiring. Upper conductor 29 and lower conductor 30 run horizontally through belt 1. Upper conductor 29 and lower conductor 30 are not electrically connected. Upper conductor 29 extends into each of said plurality of upper conducting holes 14. Lower conductor 30 extends into each of said plurality of lower conducting holes 15. Belt 1 comprises outside front piece 16, inside front piece 19, outside back piece 18, and inside back piece 17.

FIG. 3 is an enlarged, exploded back view of insert 20 placed between belt sections 8 and 9 with cut-away views showing electrical connections. Insert 20 is an example of one of any number of inserts which might be added into belt 1 in order to make belt 1 longer. Insert 20 is designed so that it can physically and electrically mate with belt first section 8 and belt second section 9. Additional inserts similar to insert 20 would also mate with belt first section 8 and belt second section 9 and insert 20. FIG. 3 is a back view of belt 1; therefore, belt second section 9 is shown on the left in FIG. 3, with belt first section 8 on the right, all with respect to insert 20. Male electrical connector 21 extends from belt second section 9 and mates with upper female electrical connector 26 of insert 20. Lower male electrical connector 22 extends from insert 20 and mates with female electrical connector 25 in belt second section 9. Upper male electrical connector 23 extends from insert 20 and mates with female electrical connector 28 in belt first section 8. Male electrical connector 24 extends from belt first section 8 and mates with lower female electrical connector 27 of insert 20. Upper conductor 31 in insert 20 is similar to upper conductor 29 in belt 1. Lower conductor 32 in insert 20 is similar to lower conductor 30 in belt 1. Upper conductor 31 connects to the plurality of upper conducting holes 37 in insert 20. The lower conductor 32 connects to the plurality of lower conducting holes 38 in insert 20. The plurality of upper conducting holes 37 in insert 20 are similar to the plurality of upper conducting holes 14 in belt 1. The plurality of lower conducting holes 38 in insert 20 are similar to the plurality of lower conducting holes 15 in belt 1. The plurality of lights 2, 3, 4 and 5 and the power pack 6 may be placed anywhere along belt 1, including belt first section 8 and belt second section 9, insert 20, or any other inserts similar to insert 20. Belt first section 8 has a fastener hole 34. Insert 20 has fastener holes 35 and 36, Belt second section 9 has a fastener hole 33. Belt fastener 7 and a similar belt fastener 41 are shown in FIG. 3. Belt fastener 7 has attaching pieces 39 and 40. Belt fastener 41 has attaching pieces 42 and 43. In securing belt fastener 41, attaching piece 42 would extend through fastener hole 35. Attaching piece 43 would extend through fastener hole 33. The belt fastener may be reversed one hundred eighty (180° ) degrees with attaching piece 42 extending through fastener hole 33 and attaching piece 43 extending through fastener hole 35. In securing belt fastener 7, attaching piece 39 would extend through fastener hole 34. Attaching piece 40 would extend through fastener hole 36. The belt fastener may be reversed one hundred eighty (180° ) degrees with attaching piece 39 extending through fastener hole 36 and attaching piece 40 extending through fastener hole 34. The belt fasteners 7 and 41 physically secure the belt sections together. The various male and female connectors electrically secure the belt together, while also providing a physical contact. The belt fasteners 7 and 41 can be decorative pieces with different physical designs, all within the scope of the invention. If other inserts such as insert 20 are utilized to expand belt 1, then other belt fasteners such as fasteners 7 and 41 will be utilized.

FIG. 4 is an enlarged sectional view of light 2 attached to belt 1. Lights 2, 3, 4 and 5 are of all similar design and construction. More or fewer lights may be utilized on the belt as may be desired. Light 2 has a lens cover 44, covering light bulb 46. Lens cover 44 was previously shown in FIG. 1 as lens cover 69. A rear reflector 45 reflects light from light bulb 46. Lens cover 44 has a snap-on edge 50 so that the lens cover 44 may be easily removed and replaced by different designs or different colored lenses. Light 2 has a base 73. Secured within base 73 is wired bulb holder 47. Light bulb 46 is secured within wired bulb holder 47. Extending from wired bulb holder 47 is electrical wire 48 which is connected to extended conducting shaft 53. Extending from wired bulb holder 47 is electrical wire 49 which is connected to extended conducting shaft 54. Extended conducting shaft 53 extends from piece 73 and through belt 1 where it makes electrical contact with upper conductor 29 in belt 1. Extended conducting shaft 54 extends from piece 73 and through belt 1 where it makes electrical contact with lower conductor 30 in belt 1. Non-conducting screw 51 secures into extended conducting shaft 53 to secure light 2 onto belt 1. Non-conducting screw 52 secures into extended conducting shaft 54 to secure light 2 onto belt 1. By simply removing screws 51 and 52, the light 2 can be placed anywhere along belt 1, by placing extended conducting shaft 53 through one of the plurality of upper conducting holes 14 and by placing extended conducting shaft 54 through one of the plurality of lower conducting holes 15. Non-conducting screws 51 and 52 would then be replaced within extended conducting shaft 53 and 54 to secure the light at that point in the belt 1. All of the plurality of lights 2, 3, 4 and 5, along with any other similarly constructed lights, may be placed as desired on belt 1. All lights will be physically secured onto belt 1 and will electrically be in parallel.

FIG. 5 is an enlarged cut-away view of power pack 6 attached to belt 1. On the outer surface 68 of power pack 6, are located signal receiving means 55 and switch 57. Switch 57 may be utilized to activate or de-activate the lights on belt 1. A variable impedance means, or variable resistance means, 56 is responsive to the signal received from the signal receiving means 55. Signal receiving means 55 may be a microphone. Power pack 6 includes a power supply 58. Extended conducting shafts 59 and 60 extend from base 67 through belt 1 and are secured thereto by non-conducting screws 61 and 62. Extended conducting shafts 59 and 60 are similar to extended conducting shafts 53 and 54. Non-conducting screws 61 and 62 are similar to non-conducting screws 51 and 52. Power pack 6 is connected electrically to upper conductor 29 and lower conductor 30 in belt 1. Lower conductor 30 is connected to extended conducting shaft 60. Extended conducting shaft 60 is connected by electrical conductor 63 to power supply 58. Power supply 58 is connected by electrical conductor 64 to switch 57. Switch 57 is connected by electrical conductor 65 to variable impedance means 56. Variable impedance means 56 is connected by electrical conductor 66 to extended conducting shaft 59. Extending conducting shaft 59 is physically and electrically connected to upper conductor 29 in belt 1. The power pack 6 is placed in parallel with the plurality of lights 2, 3, 4 and 5 in belt 1.

FIG. 6 is a black box schematic diagram of the electrical operation of belt 1. As may be seen, the contents of the power pack 6 which are the power supply 58, switch 57, and variable resistance means, or variable impedance means 56, are in series with each other. The entire power pack 6 is in parallel with the plurality of lights 2, 3, 4 and 5. When switch 57 is open, there is no power to the lights and there will be no light. When switch 57 is closed, the power supply will provide power which will be electrically dropped across the variable impedance means 56 and the series of lights in parallel. When the variable impedance means 56 is a very high impedance, in comparison to the lights, the majority of the power will be dropped across the variable impedance means 56 and the lights will be dim or even off. When the variable impedance means 56 is of a very low impedance in comparison with the plurality of lights, then the majority of the power will be dropped across the lights and they will be bright. As the variable impedance means 56 varies according to sound received, the lights will be constantly changing in brightness. This design, therefore, satisfied the objectives of the invention in providing a belt with lights thereon which are operative responsive to a sound responsive means. The belt 1 may be utilized by dancers, as a novelty, or in any other way desired by the user. The user has control over the use of the lights by switch 57. The variable resistance means, or variable impedance means 56, may be of any electrical or electronic design desired with a criterion only that, with the present wiring, it should have a low resistance, or impedance, level for loud sounds received and a high resistance, or impedance, level for low sounds received.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

I claim:

1. A device connected around a body comprising:
(a) a belt;
(b) power means secured to said belt;
(c) sound responsive means secured to said belt;
(d) light means secured to said belt operative responsive to said sound responsive means;
(e) a plurality of belt sections; and
(f) a plurality of fasteners connecting said plurality of belt sections together.

2. A device according to claim 1 wherein said sound responsive means comprises a microphone.

3. A device according to claim 1 wherein said belt comprises:
(a) a plurality of upper conducting holes;
(b) a plurality of lower conducting holes;
(c) an upper conductor extending through each of said plurality of upper conducting holes; and
(d) a lower conductor extending through each of said plurality of lower conducting holes.

4. A device according to claim 3 wherein said belt comprises:
(a) a plurality of belt sections; and
(b) a plurality of fasteners connecting said plurality of belt sections together.

5. A device according to claim 4 wherein said belt comprises a fastener hole in each of said plurality of belt sections through which one of said plurality of fasteners is secured.

6. A device according to claim 5 wherein said belt further comprises an insert connectable between any two of said plurality of belt sections.

7. A device according to claim 4 wherein said belt further comprises a female electrical connector and a male electrical connector, both connected to one end of each of said plurality of belt sections and connectable to any other one end of each of said plurality of belt sections.

8. A device according to claim 6 wherein said belt further comprises a female electrical connector and a male electrical connector, both connected to one end of each of said plurality of belt sections and connectable to any other one end of each of said plurality of belt sections.

9. A device according to claim 8 wherein said insert comprises:
(a) a first female electrical connector and a first male electrical connector connected to a first end of said insert;
(b) a second female electrical connector and a second male electrical connector connected to a first end of said insert;
wherein said insert is connectable to said plurality of belt sections by insertion of said first and said second male electrical connectors of said insert into said female electrical connectors of said plurality of belt sections, and insertion of said male electrical connectors from said plurality of belt sections into said first and said second female electrical connectors of said insert.

10. A device according to claim 9 wherein said insert further comprises:
(a) two fastener holes, one at each end of said insert, through which one of said plurality of fasteners is secured at said each end of said insert;
(b) a plurality of insert upper conducting holes;
(c) a plurality of insert lower conducting holes;
(d) an insert upper conductor extending through each of said plurality of insert upper conducting holes; and
(e) an insert lower conductor extending through each of said plurality of insert lower conducting holes.

11. A device according to claim 10 wherein said plurality of fasteners extend through said plurality of belt sections and said insert when fastening said plurality of belt sections and said insert together.

12. A device according to claim 11 wherein a plurality of said inserts is connected between said plurality of belt sections.

13. A device according to claim 12 wherein said sound responsive means comprises a microphone.

14. A device according to claim 3 wherein said light means comprises a plurality of lights wherein each of said plurality of lights comprises a base, a bulb holder secured to said base, a bulb secured within said bulb holder, a reflector secured to said base, and a lens cover connected to said reflector and covering said bulb, and a plurality of conducting shafts secured to said base and electrically connected to said bulb.

15. A device according to claim 14 wherein:
(a) one of said plurality of conducting shafts extends through one of said plurality of upper conducting holes in said belt and makes electrical contact with said upper conductor; and
(b) a second one of said plurality of conducting shafts extends through one of said plurality of lower conducting holes and makes electrical contact with said lower conductor;
whereby each of said plurality of lights is connected together electrically in parallel.

16. A device according to claim 15 wherein said power means and said sound responsive means are connected in series with a switch means and are secured within a power pack.

17. A device according to claim 16 wherein said power pack is secured on a power pack base and further comprises a plurality of power pack conducting shafts secured to said power pack base and electrically connected to the series circuit of said switch means, power means, and sound responsive means.

18. A device according to claim 17 wherein:

(a) one of said plurality of power pack conducting shafts extends through one of said plurality of upper conducting holes in said belt and makes electrical contact with said upper conductor; and (b) a second one of said plurality of power pack conducting shafts extends through one of said plurality of lower conducting holes and makes electrical contact with said lower conductor;

whereby each of said plurality of lights is connected together electrically in parallel.

19. A device according to claim 18 wherein said plurality of connecting shafts and said plurality of power pack connecting shafts are secured to said belt by a plurality of non-conducting fastening means.

20. A device according to claim 1 wherein said light means comprises a plurality of lights.

21. A device according to claim 20 wherein each of said plurality of lights comprises:

(a) a base;

(b) a bulb holder secured to said base;

(c) a bulb secured within said bulb holder;

(d) a reflector secured to said base; and (e) a lens cover connected to said reflector and covering said bulb.

22. A device according to claim 21 wherein said lens cover may be any color and light reflected through said lens cover will be the color of said lens cover.

23. A device according to claim 22 wherein each lens cover of said plurality of lights is interchangeable.

24. A device according to claim 21 wherein each of said plurality of lights further comprises a plurality of conducting shafts secured to said base and electrically connected to said bulb.

25. A device according to claim 1 wherein said power means and said sound responsive means are electrically connected in series within a power pack.

26. A device according to claim 25 wherein said power pack further comprises switch means in series with said power means and said sound responsive means.

27. A device according to claim 26 wherein said power pack is secured on a power pack base and further comprises a plurality of power pack conducting shafts secured to said power pack base and electrically connected to the series circuit of said switch means, power means, and sound responsive means.

* * * * *